US006213728B1

(12) United States Patent
Kato et al.

(10) Patent No.: US 6,213,728 B1
(45) Date of Patent: Apr. 10, 2001

(54) VARIABLE DISPLACEMENT COMPRESSOR

(75) Inventors: Keiichi Kato; Hirotaka Kurakake; Taku Adaniya; Satoshi Inaji, all of Kariya (JP)

(73) Assignee: Kabushiki Kaisha Toyoda Jidoshokki Seisakusho + , Kariya (JP)

( * ) Notice: Subject to any disclaimer, the term of this patent is extended or adjusted under 35 U.S.C. 154(b) by 0 days.

(21) Appl. No.: 09/429,572

(22) Filed: Oct. 28, 1999

(30) Foreign Application Priority Data

Oct. 30, 1998 (JP) ..... 10-310589
Mar. 30, 1999 (JP) ..... 11-088395

(51) Int. Cl.[7] ..... F04B 1/26
(52) U.S. Cl. ..... 417/222.2
(58) Field of Search ..... 417/222.2, 269, 417/270, 222.1

(56) References Cited

U.S. PATENT DOCUMENTS 4,702,677 10/1987 Takenaka et al. ..... 417/222
4,723,891 * 2/1988 Takenaka et al. ..... 417/222
5,189,886 3/1993 Terauchi ..... 62/228.5
5,332,365 7/1994 Taguchi ..... 417/222.2
5,613,836 3/1997 Takenaka et al. ..... 417/222.2
5,823,294 * 10/1998 Mizutani ..... 184/6.3
5,842,835 * 12/1998 Kawaguchi ..... 417/222.2
6,109,883 * 8/2000 Kawaguchi ..... 417/269

FOREIGN PATENT DOCUMENTS 0 486 257 A1 5/1992 (EP) ..... F04B/1/28
0 992 746 A2 4/2000 (EP) ..... F25B/49/02
2153 922 8/1985 (GB) ..... F04B/49/00
10-141223 5/1998 (JP) .
11-050961 2/1999 (JP) .

* cited by examiner

*Primary Examiner*—Teresa Walberg
*Assistant Examiner*—Vinod D Patel
(74) *Attorney, Agent, or Firm*—Morgan & Finnegan, LLP

(57) ABSTRACT

A variable displacement compressor has a housing, which defines a crank chamber, a suction chamber, and a discharge chamber. A release passage connects the crank chamber to the suction chamber, which allows gas to flow from the crank chamber to the suction chamber. A release valve is located in the release passage. The release valve regulates gas flow in the release passage. A controller controls the release valve to limit the pressure in the crank chamber to prevent the pressure in the crank chamber from becoming undesirably high. This can prevent the pressure in the crank chamber from excessively increasing.

20 Claims, 6 Drawing Sheets

VARIABLE DISPLACEMENT COMPRESSOR

BACKGROUND OF THE INVENTION

The present invention relates to a variable displacement compressor for vehicle air-conditioning.

FIG. 8 shows a prior art variable displacement compressor. A drive shaft is rotatably supported in the housing 101, which encloses a crank chamber 102. A lip seal 104 is located between the housing 101 and the drive shaft 103 to prevent leakage of fluid from the housing 101.

An electromagnetic friction clutch 105 is located between the drive shaft 103 and the engine Eg, which serves as a power source. The clutch 105 includes a rotor 106 that is coupled to the engine Eg, an armature 107 that is fixed to the drive shaft 103, and an electromagnetic coil 108. When the coil 108 is excited, the armature 107 is attracted to and contacts the rotor 106. In this state, power of the engine Eg is transmitted to the drive shaft 103. When the coil 108 is de-excited, the armature 107 is separated from the rotor 106, which disconnects the power transmission from the engine Eg to the drive shaft 103.

A lug plate 109 is fixed to the drive shaft 103 in the crank chamber 102. A thrust bearing 122 is located between the lug plate 109 and the housing 101. A swash plate 110 is coupled to the lug plate 109 via a hinge mechanism 111. The swash plate 110 is supported by the drive shaft 103 such that the swash plate 110 slides axially and inclines with respect to the axis L of the drive shaft 103. The hinge mechanism 111 causes the swash plate 110 to integrally rotate with the drive shaft 103. When the swash plate 110 contacts the limit ring 112, the swash plate 110 is positioned at the minimum inclination position.

The housing 101 includes cylinder bores 113, a suction chamber 114, and a discharge chamber 115. A piston 116 is accommodated in each cylinder bore 113 and is coupled to the swash plate 110. A valve plate 117 partitions the cylinder bores 113 from a suction chamber 114 and a discharge chamber 115.

When the drive shaft 103 rotates, the swash plate 110 reciprocates each piston 116. Accompanying this, refrigerant gas in the suction chamber 114 flows into each cylinder bore 113 through the corresponding suction port 117*a* and suction valve 117*b,* which are formed in the valve plate 117. Refrigerant gas in each cylinder bore 113 is compressed to reach a predetermined pressure and is discharged to the discharge chamber 115 through the corresponding discharge port 117*c* and discharge valve 117*d,* which are formed in the valve plate 117.

An axial spring 118 is located between the housing 101 and the drive shaft 103. The axial spring 118 urges the drive shaft 103 frontward (leftward in FIG. 8) along the axis L and limits axial chattering of the drive shaft 103. A thrust bearing 123 is located between the axial spring 118 and an end surface of the drive shaft 103. The thrust bearing 123 prevents transmission of rotation from the drive shaft 103 to the axial spring 118.

A bleed passage 119 connects the crank chamber 102 to the suction chamber 114. A pressurizing passage 120 connects the discharge chamber 115 to the crank chamber 102. A displacement control valve, which is an electromagnetic valve, adjusts the opening size of the pressurizing passage 120.

The control valve 121 adjusts the flow rate of refrigerant gas from the discharge chamber 115 to the crank chamber 102 by varying the opening size of the pressurizing passage 120. This varies the inclination of the swash pate 110, the stroke of each piston 116, and the displacement.

When the clutch 105 is disengaged, or when the engine Eg is stopped, the control valve 121 maximizes the opening size of the pressurizing passage 120. This increases the pressure in the crank chamber 102 and minimizes the inclination of the swash plate 110. As a result, the compressor stops when the inclination of the swash plate 110 is minimized, or when the displacement is minimized. Accordingly, since the displacement is minimized, the compressor is started with a minimal torque load. This reduces torque shock when the compressor is started.

When the cooling load on a refrigeration circuit that includes the compressor is great, for example, when the temperature in a vehicle passenger compartment is much higher than a target temperature set in advance, the control valve 121 closes the pressurizing passage 120 and maximizes the displacement of the compressor.

Suppose that when the compressor is operating at maximized displacement, it is stopped by disengagement of the clutch 105 or by shutting off the engine Eg. In this case, the control valve 121 quickly maximizes the opening size of the closed pressurizing passage 120 to minimize the displacement. Also, when the vehicle is suddenly accelerated while the compressor is operating at maximum displacement, the control valve 121 quickly maximizes the opening size of the pressurizing passage 120 to minimize the displacement and to reduce the load applied to the engine Eg. Accordingly, refrigerant gas in the discharge chamber 115 is quickly supplied to the crank chamber 102. Though some refrigerant gas flows to the suction chamber 114 through the bleed passage 119, the pressure in the crank chamber 102 quickly increases.

Therefore, the swash plate 110, when at a minimum displacement position (as shown by the broken line in FIG. 8) is pressed against a limit ring 112. Also, the swash plate 110 pulls the lug plate 109 in a rearward direction (rightward in FIG. 8) through the hinge mechanism 111. As a result, the drive shaft 103 moves axially rearward against the force of the axial spring 118.

When the drive shaft 103 moves rearward, the axial position of the drive shaft 103 with respect to a lip seal 104, which is held in the housing 101, changes. Generally, a predetermined contact area of the drive shaft 103 contacts the lip seal 104. Foreign particles such as sludge exist on the peripheral surface of the drive shaft 103 that is outside the predetermined contact area. Therefore, when the axial position of the drive shaft 103 with respect to the lip seal 104 changes, the sludge will be located between the lip seal 104 and the drive shaft 102. This lowers the sealing performance of the lip seal 104 and may cause leakage of refrigerant gas from the crank chamber 102.

When the operation of the compressor is stopped by the disengagement of the clutch 105 and the drive shaft 103 moves rearward, the armature 107, which is fixed to the drive shaft 103, moves toward the rotor 106. The clearance between the rotor 106 and the armature 107 when the clutch 105 is disengaged is set to a small value, for example, 0.5 mm. Accordingly, when the drive shaft 103 moves rearward, the clearance between the rotor 106 and the armature 107 is eliminated, which causes the armature 107 to contact the rotating rotor 106. This may cause noise and vibration or may transmit power from the engine Eg to the drive shaft 103 regardless of the disengagement of the clutch 105.

When the drive shaft 103 moves rearward, each piston 116, which is coupled to the drive shaft through the lug plate 109 and the swash plate 110, also moves rearward. This moves the top dead center position of each piston 116 toward the valve plate 117 which may permit the pistons 116 to collide with the valve plate 117. Since the control valve 121 maximizes the opening size of the pressurizing passage 120 during sudden accelerations of the vehicle while the compressor is operating, the rearward movement of the drive shaft 103 accompanying the control may cause the pistons 116 to repeatedly collide with the valve plate 117. This generates noise and vibration.

To prevent the rearward movement of the drive shaft 103, the force of the axial spring 118 can be increased. However, increasing the force of the axial spring 118 lowers the durability of the thrust bearing 123, which is located between the axial spring 118 and the drive shaft 103, lowers the durability of the thrust bearing 122, which is located between the housing 101 and the lug plate 109, and increases the load placed on the engine by the compressor.

SUMMARY OF THE INVENTION

An objective of the present invention is to provide a variable displacement compressor that can prevents the pressure in a crank chamber from excessively increasing.

To achieve the above objective, the present invention provides a variable displacement compressor comprises a housing, a cylinder bore formed in the housing, a crank chamber, a suction chamber, a discharge chamber, A piston is accommodated in the cylinder bore. A drive shaft is rotatably supported in the housing. A drive plate is coupled to the piston for converting rotation of the drive shaft to reciprocation of the piston. The drive plate is tiltably supported on the drive shaft. The drive plate moves between a maximum inclination position and a minimum inclination position in accordance with the pressure in the crank chamber. The inclination of the drive plate determines the piston stroke and the displacement of the compressor. A pressure control mechanism controls the pressure in the crank chamber to change the inclination of the drive plate. A control passage connects the crank chamber to a selected chamber in the compressor. A pressure adjusting valve is located in the control passage. The pressure adjusting valve regulates gas flow in the control passage. A controller controls the pressure adjusting valve to limit the pressure in the crank chamber to prevent the pressure in the crank chamber from becoming undesirably high.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A single head type variable displacement compressor for vehicle air-conditioners according to a first embodiment of the present invention will now be described with reference to FIGS. 1–4.

Figure 1:
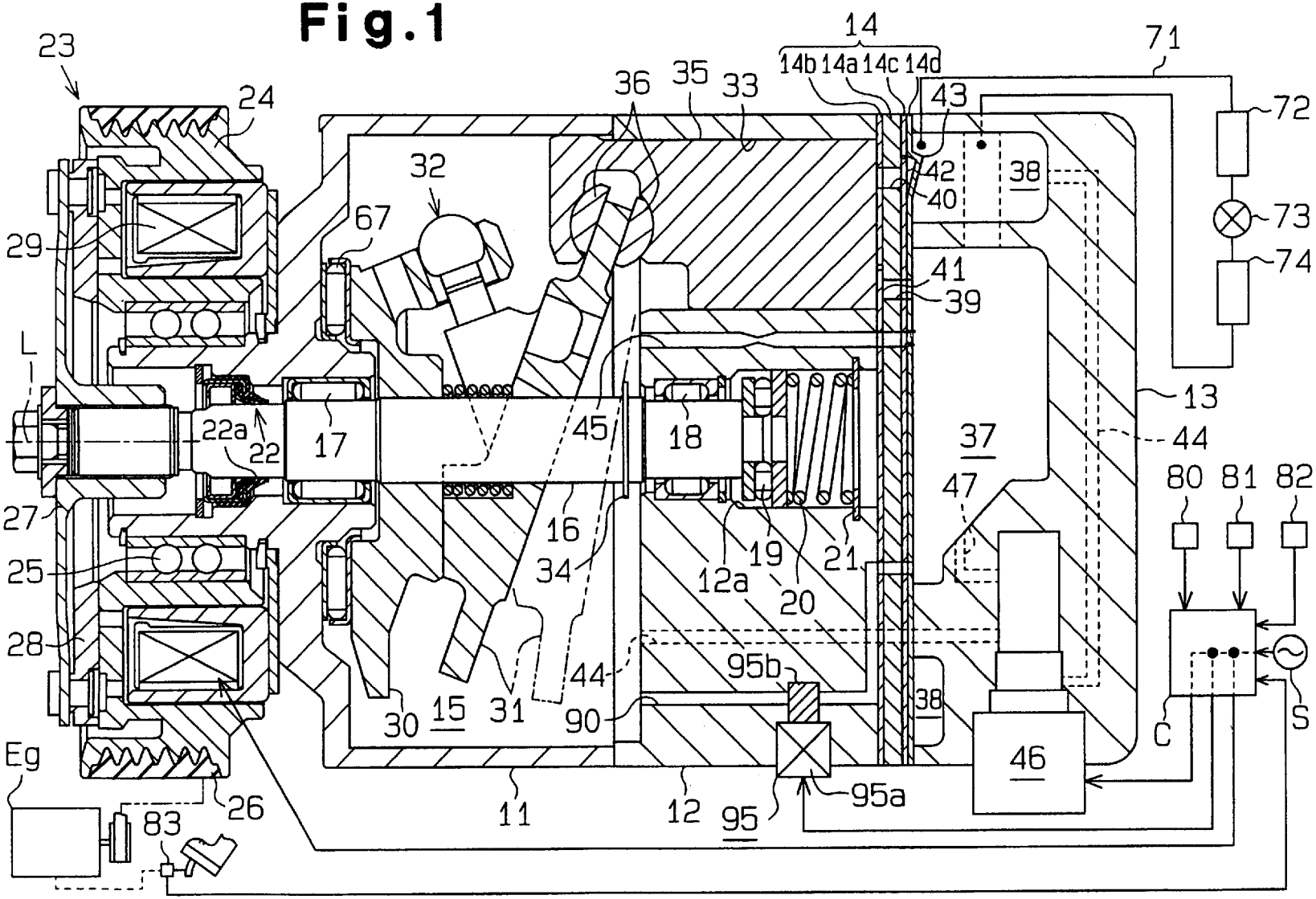
FIG. 1 is a cross sectional view showing a variable displacement compressor according to a first embodiment of the present invention.

As shown in FIG. 1, a front housing member 11 and a rear housing member 13 are coupled to a cylinder block 12. A valve plate 14 is located between the cylinder block 12 and the rear housing member 13. The front housing member 11, the cylinder block 12, and the rear housing member form a compressor housing.

Figure 2:
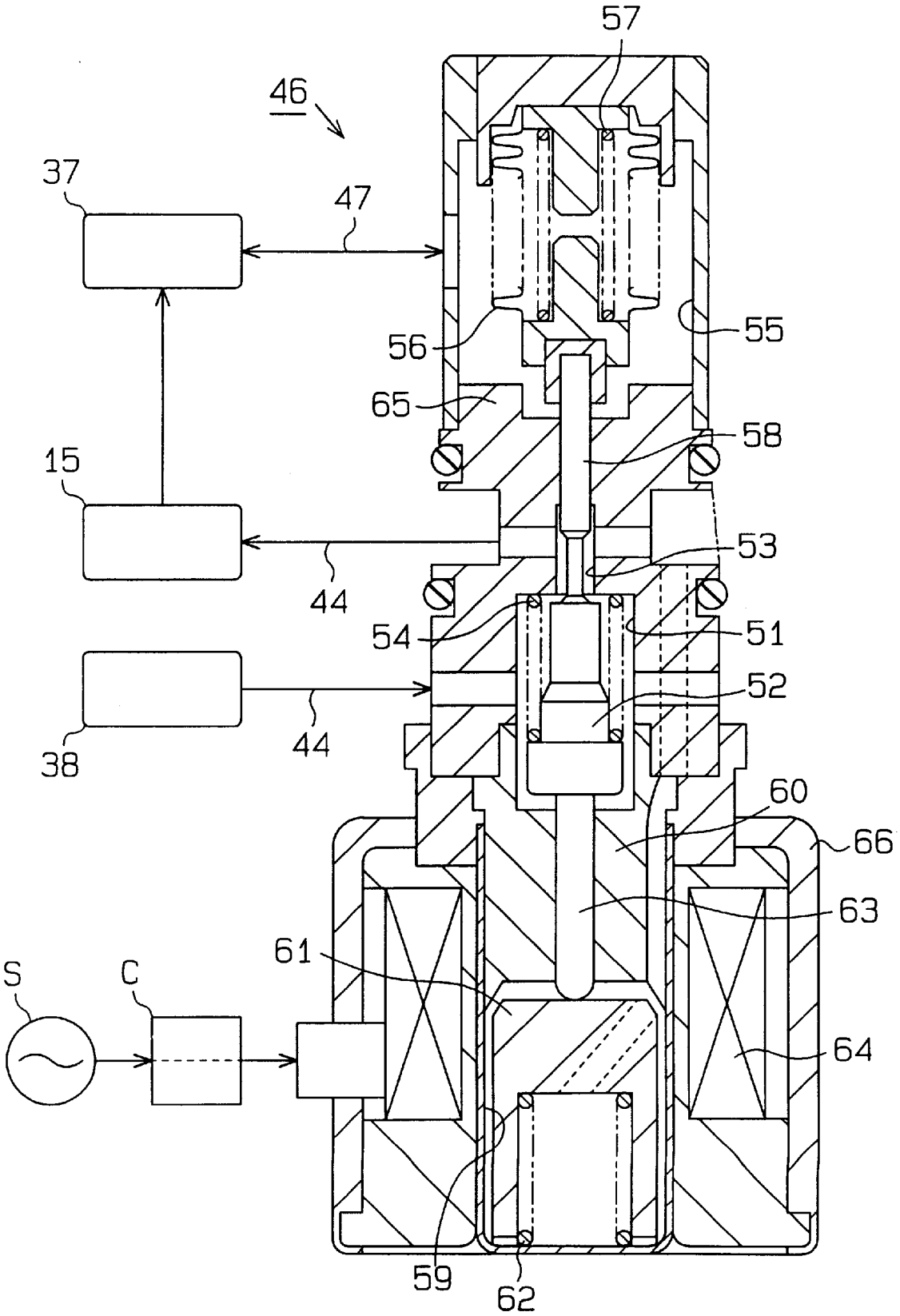
FIG. 2 is a cross sectional view showing the displacement control valve of the compressor of FIG. 1.
Figure 3:
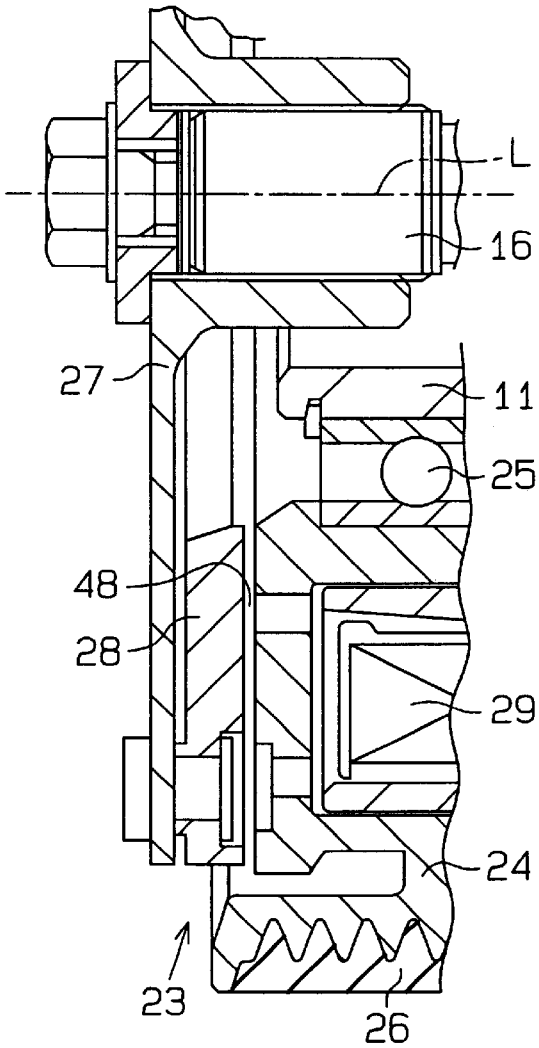
FIG. 3 is a partial enlarged cross-sectional view showing the electromagnetic friction clutch of the compressor of FIG. 1.

As shown in FIGS. 1 and 2, the valve plate 14 includes a main plate 14*a*, a first sub-plate 14*b*, a second sub-plate 14*c*, and a retainer plate 14*d*. The main plate 14*a* is located between the first sub-plate 14*b* and the second sub-plate 14*c*. The retainer plate 14*d* is located between the second sub-plate 14*c* and the rear housing member 13.

A crank chamber 15 is defined between the front housing member 11 and the cylinder block 12. A drive shaft 16 passes through the crank chamber 15 and is rotatably supported by the front housing member 11 and the cylinder block 12.

The drive shaft 16 is supported in the front housing member 11 through the radial bearing 17. A central bore 12*a* is formed substantially in the center of the cylinder block 12. The rear end of the drive shaft 16 is located in the central bore 12*a* and is supported in the cylinder block 12 through the radial bearing 18. A spring seat 21, which is a snap ring, is fixed to the inner surface of the central bore 12*a*. The thrust bearing 19 and the axial spring 20 are located in the central bore 12*a* between the rear end surface of the drive shaft 16 and the spring seat 21. The axial spring 20, which is a coil spring, urges the drive shaft frontward (leftward in FIG. 1) through the thrust bearing 19. The axial spring 20 is an urging member. The thrust bearing 19 prevents transmission of rotation from the drive shaft 16 to the axial spring 20.

The front end of the drive shaft 16 projects from the front housing member 11. A lip seal 22, which is a shaft sealing assembly, is located between the drive shaft 16 and the front housing member 11 to prevent leakage of refrigerant gas along the surface of the drive shaft 16. The lip seal 22 includes a lip ring 22*a*, which is pressed against the surface of the drive shaft 16.

An electromagnetic friction clutch 23 is located between an engine Eg, which serves as an external power source, and the drive shaft 16. The clutch 23 selectively transmits power from the engine Eg to the drive shaft 16. The clutch 23 includes a rotor 24, a hub 27, an armature 28, and an electromagnetic coil 29. The rotor 24 is rotatably supported by the front end of the front housing member 11 through an angular bearing 25. A belt 26 is received by the rotor 24 to transmit power from the engine Eg to the rotor 24. The hub 27, which has elasticity, is fixed to the front end of the drive shaft 16 and supports the armature 28. The armature 28 is arranged to face the rotor 24. The electromagnetic coil 29 is supported by the front wall of the front hosing member 11 to face the armature 28 across the rotor 24.

When the coil 29 is excited while the engine Eg is running, an attraction force based on electromagnetic force is generated between the armature 28 and the rotor 24.

Accordingly, the armature 28 contacts the rotor 24, which engages the clutch 23. When the clutch 23 is engaged, power from the engine Eg is transmitted to the drive shaft 16 through the belt 26 and the clutch 23 (See FIG. 1). When the coil 29 is de-excited in this state, the armature 28 is separated from the rotor 24 by the elasticity of the hub 27, which disengages the clutch 23. When the clutch 23 is engaged, transmission of power from the engine Eg to the drive shaft 16 is disconnected (See FIG. 3).

As shown in FIG. 1, a lug plate 30 is fixed to the drive shaft 16 in the crank chamber 15. A thrust bearing 67 is located between the lug plate 30 and the inner wall of the front housing member 11. A swash plate 31, which serves as a drive plate, is supported on the drive shaft 16 to slide axially and to incline with respect to the drive shaft 16. A hinge mechanism 32 is located between the lug plate 30 and the swash plate 31. The swash plate 31 is coupled to the lug plate 30 through the hinge mechanism 32. The hinge mechanism 32 integrally rotates the swash plate 31 with the lug plate 30. The hinge mechanism 32 also guides the swash plate 31 to slide along and incline with respect to the drive shaft 16. As the swash plate 31 moves toward the cylinder block 12, the inclination of the swash plate 31 decreases. As the swash plate 31 moves toward the lug plate 30, the inclination of the swash plate 31 increases.

A limit ring 34 is attached to the drive shaft 16 between the swash plate 31 and the cylinder block 12. As shown by the broken line in FIG. 1, the inclination of the swash plate 31 is minimized when the swash plate 31 abuts against the limit ring 34. On the other hand, as shown by solid lines in FIG. 1, the inclination of the swash plate 31 is maximized when the swash plate 31 abuts against the lug plate 30.

Cyclinder bores 33 are formed in the cylinder block 12. The cylinder bores 33 are arranged at equal annular intervals about the axis L of the drive shaft 16. A single head piston 35 is accommodated in each cylinder bore 33. Each piston 35 is coupled to the swash plate 31 through a pair of shoes 36. The swash plate 31 converts rotation of the drive shaft 16 into reciprocation of the pistons 35.

A suction chamber 37, which is a suction pressure zone, is defined in the substantial center of the rear housing member 13. A discharge chamber 38, which is a discharge pressure zone, is formed in the rear housing member 13 and surrounds the suction chamber 37. The main plate 14*a* of the valve plate 14 includes suction ports 39 and discharge ports 40, which correspond to each cylinder bore 33. The first sub-plate 14*b* includes suction valves 41, which correspond to suction ports 39. The second sub-plate 14*c* includes discharge valves 42, which correspond to the discharge ports 40. The retainer plate 14*d* includes retainers 43, which correspond to the discharge valves 42. Each retainer 43 determines the maximum opening size of the corresponding discharge valve 42.

When each piston 35 moves from the top dead center position to the bottom dead center position, refrigerant gas in the suction chamber 37 flows into the corresponding cylinder bore 33 through the corresponding suction port 39 and suction valve 41. When each piston 35 moves from the bottom dead center position to the top dead center position, refrigerant gas in the corresponding cylinder bore 33 is compressed to a predetermined pressure and is discharged to the discharge chamber 38 through the corresponding discharge port 40 and discharge valve 42.

A pressurizing passage 44 connects the discharge chamber 38 to the crank chamber 15. A bleed passage 45, which is a pressure release passage, connects the crank chamber 15 to the suction chamber 37. The bleed passage 45 functions as a control passage that connects the crank chamber 15 to a selected chamber in the compressor, which is the suction chamber 37 in this embodiment. A displacement control valve 46 is located in the pressurizing passage 44. The control valve 46 adjusts the flow rate of refrigerant gas from the discharge chamber 38 to the crank chamber 15 by varying the opening size of the pressurizing passage 44. The bleed passage 45 and the control valve 46 form a pressure control mechanism. The pressure in the crank chamber 15 is varied in accordance with the relation between the flow rate of refrigerant from the discharge chamber 38 to the crank chamber 15 and that from the crank chamber 15 to the suction chamber 37 through the bleed passage 45. Accordingly, the difference between the pressure in the crank chamber 15 and the pressure in the cylinder bores 33 is varied, which varies the inclination of the swash plate 31. This varies the stroke of each piston 35 and the displacement.

The control valve 46 will now be described.

As shown in FIG. 2, the control valve 46 includes a valve housing 65 and a solenoid 66, which are coupled together. A valve chamber 51 is defined between the valve housing 65 and the solenoid 66. The valve chamber 51 accommodates a valve body 52. A valve hole 53 opens in the valve chamber 51 and faces the valve body 52. An opener spring 54 is accommodated in the valve chamber 51 and urges the valve body 52 to open the valve hole 53. The valve chamber 51 and the valve hole 53 form part of the pressurizing passage 44.

A pressure sensitive chamber 55 is formed in the valve housing 65. The pressure sensitive chamber 55 is connected to the suction chamber 37 through a pressure detection passage 47. A bellows 56, which is a pressure sensitive member, is accommodated in the pressure sensitive chamber 55. A spring 57 is located in the bellows 56. The spring 57 determines the initial length of the bellows 56. The bellows 56 is coupled to and operates the valve body 52 through a pressure sensitive rod 58, which is integrally formed with the valve body 52.

A plunger chamber 59 is defined in the solenoid 66. A fixed iron core 60 is fitted in the upper opening of the plunger chamber 59. A movable iron core 61 is accommodated in the plunger chamber 59. A follower spring 62 is located in the plunger chamber 59 and urges the movable core 61 toward the fixed core 60. A solenoid rod 63 is integrally formed at the lower end of the valve body 52. The distal end of the solenoid rod 63 continuously abuts against the movable core 61 by the forces of the opener spring 54 and the follower spring 62. In other words, the valve body 52 moves integrally with the movable core 61 through the solenoid rod 63. The fixed core 60 and the movable core 61 are surrounded by a cylindrical electromagnetic coil 64.

As shown in FIG. 1, the suction chamber 37 is connected to the discharge chamber 38 through an external refrigerant circuit 71. The external refrigerant circuit 71 includes a condenser 72, an expansion valve 73, an evaporator 74. The external refrigerant circuit 71 and the variable displacement compressor constitute a refrigeration circuit.

A controller C is connected to an air-conditioner switch 80, which is a main switch of the vehicle air-conditioner, a temperature adjuster 82 for setting a target temperature in a passenger compartment, and a gas pedal sensor 83. The controller C is, for example, a computer, which is located on current supply lines between a power source S (a vehicle battery) and the clutch 23 and between the power source S and the control valve 46. The controller C supplies electric current from the power source S to the electromagnetic coils 29, 64. The controller C controls current supply to each coil 29, 64 based on information including the ON/Off state of the air-conditioner switch 80, a temperature detected by the temperature sensor 81, a target temperature set by the temperature adjuster 82, and the gas pedal depression degree detected by the gas pedal sensor 83.

When the engine Eg is stopped (when the ignition switch is positioned at the accessory off position), most of the current supply to the electric equipment of the vehicle is stopped. Accordingly, the supply of current from the power source S to each coil 29, 64 is stopped. That is, when the operation of the engine Eg is stopped, the current supply lines between the power source S and each coil 29, 64 are disconnected upstream of the controller C.

Operation of the control valve 46 will now be described.

The controller C supplies a predetermined electric current to the coil 29 of the clutch 23 when the air-conditioner switch 80 is turned on during the operation of the engine Eg, and the temperature detected by the temperature sensor 81 is higher than the target temperature set by the temperature adjuster 82. This engages the clutch 23 and starts the compressor.

The bellows 56 of the control valve 46 is displaced in accordance with the pressure in the suction chamber 37, which is connected to the pressure sensitive chamber 55. The displacement of the bellows 56 is transmitted to the valve body 52 through the pressure sensitive rod 58. On the other hand, the controller C determines the electric current value supplied to the coil 64 of the control valve 46 based on the temperature detected by the temperature sensor 81 and the target temperature set by the temperature adjuster 82. When an electric current is supplied to the coil 64, an electromagnetic attraction force in accordance with the value of the current is generated between the fixed core 60 and the movable core 61. The attraction force is transmitted to the valve body 52 through the solenoid rod 63. Accordingly, the valve body 52 is urged to reduce the opening size of the valve hole 53 against the force of the opener spring 54.

In this way, the opening size of the valve hole 53 by the valve body 52 is determined by the equilibrium of the force applied from the bellows 56 to the valve body 52, the attraction force between the fixed core 60 and the movable core 61, and the force of each spring 54, 62.

As the cooling load on the refrigeration circuit increases, for example, as the temperature detected by the temperature sensor 81 becomes higher than the target temperature set by the temperature adjuster 82, the controller C instructs the control valve 46 to increase the current supply to the coil 64. This increases the attraction force between the fixed core 60 and the movable core 61 and increases the force that urges the valve body 52 toward the closed position of the valve hole 53. In this case, the bellows 56 operates the valve body 53 targeting a relatively low suction pressure. In other words, as the current supply increases, the control valve 46 adjusts the displacement of the compressor to maintain a relatively low suction pressure (corresponding to a target suction pressure).

As the opening size of the valve hole 53 is reduced by the valve body 52, the flow rate of refrigerant gas from the discharge chamber 38 to the crank chamber 15 through the pressurizing passage 44 is reduced. On the other hand, refrigerant gas in the crank chamber 15 continuously flows to the suction chamber 37 through the bleed passage 45. This gradually decreases the pressure in the crank chamber 15. Accordingly, the difference between the pressure in the crank chamber 15 and the pressure in the cylinder bores 33 is decreased, which increases the inclination of the swash plate 31 and the displacement of the compressor.

As the cooling load on the refrigeration circuit decreases, for example, as the difference between the temperature detected by the temperature sensor 81 and the target temperature set by the temperature adjuster 82 decreases, the controller C reduces the current supply to the coil 64. This weakens the attraction force between the fixed core 60 and the movable core 61 and reduces the force that urges the valve body 52 toward the closed position of the valve hole 53. In this case, the bellows 56 operates the valve body 52 targeting a relatively high suction pressure. In other words, as the current supply decreases, the control valve 46 adjusts the displacement of the compressor to maintain a relatively high suction pressure (corresponding to a target suction pressure).

As the opening size of the valve hole 53 increases, the flow rate of refrigerant gas from the discharge chamber 38 to the crank chamber 15 is increased, which gradually increases the pressure in the crank chamber 15. This increases the difference between the pressure in the crank chamber 15 and the pressure in the cylinder bores 12*a* and reduces the inclination of the swash plate 31 and the displacement of the compressor.

A structural characteristic of the present embodiment will now be described.

Figure 4:
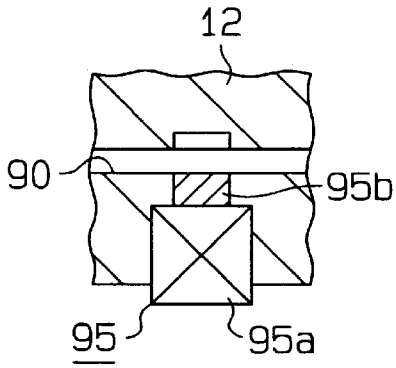
FIG. 4 is a partial enlarged view showing the release valve of the compressor of FIG. 1.

As shown in FIG. 1, a pressure release passage 90 is independent from the bleed passage 45 and connects the crank chamber 15 to the suction chamber 37. The release passage 90 functions as a control passage, which connects the crank chamber 15 to a selected chamber, which is the suction chamber 37 in this embodiment. As shown in FIGS. 1 and 4, a release valve 95, which is an electromagnetic valve in this embodiment, is located in the release passage 90. The release valve 95 includes a solenoid 95*a*, which is controlled by the controller C, and a valve body 95*b*, which varies the opening size of the release passage 90. When the solenoid 95*a* is excited, the valve body 95*b* closes the release passage 90 (See FIG. 1). When the solenoid 95*a* is de-excited, the valve body 95*b* opens the release passage 90 (See FIG. 4).

When the air-conditioner switch 80 is turned off during the operation of the compressor, the controller C stops the current supply to the coil 29 and disengages the clutch 23 and simultaneously stops the current supply to the coil 64 of the control valve 46. Further, the controller C stops the current supply to the solenoid 95*a* of the release valve 95.

When the gas pedal depression degree, which is detected by the gas pedal sensor 83, is greater than a predetermined value during the operation of the compressor, the controller C judges that the vehicle is being quickly accelerated and stops the current supply to the coil 64 of the control valve 46 and to the solenoid 95*a* of the release valve 95 for a predetermined period.

When the engine Eg is stopped during the operation of the compressor, the current supply lines between the power source S and each coil 29, 64 and between the power source S and the solenoid 95*a* are disconnected upstream of the controller C. Accordingly, the current supply to the coil 29 is stopped and the clutch 23 is disengaged, which stops the current supply to the coil 64 and the solenoid 95*a*.

When the clutch 23 is disengaged or the engine Eg is stopped, the current supply to the coil 64 of the control valve 46 is stopped. Then, the attraction force between the fixed core 60 and the movable core 61 disappears, and the control valve 46 fully opens the pressurizing passage 44. This increases the pressure in the crank chamber 15 and minimizes the inclination of the swash plate 31. As a result, the compressor is stopped when the inclination of the swash plate 31 is minimized, or when the displacement is minimized. Accordingly, since the compressor is started from the minimum displacement state, which produces a minimum torque load, the torque shock of starting the compressor is limited.

When the gas pedal depression degree detected by the gas pedal sensor 83 is greater than a predetermined value, the current supply to the coil 64 is stopped. This causes the control valve 46 to fully open the pressurizing passage 44. As a result, the inclination of the swash plate 31 is minimized and the compressor is operated at the minimum displacement with relatively low torque load. Therefore, the load on the engine Eg is reduced and the vehicle is smoothly accelerated.

When the current supply to the coil 64 is stopped while the compressor is operated at maximum displacement, the control valve 46 quickly maximizes the opening size of the closed pressurizing passage 44. This permits relatively high-pressure refrigerant gas in the discharge chamber 38 to flow quickly to the crank chamber 15. Since the amount of refrigerant gas that flows from the crank chamber 15 to the suction chamber 37 through the bleed passage 45 and the through hole 91*a* of the release valve 91 is limited, the pressure in the crank chamber 15 is quickly increased.

However, when the pressure in the crank chamber 15 increases to an excessive degree by the discontinuation of the current supply to the coil 64, the current supply to the solenoid 95*a* is simultaneously stopped, which causes the release valve 95 to open the release passage 90 as shown in FIG. 4. Therefore, a relatively large amount of gas flows from the crank chamber 15 to the suction chamber 37 through the release passage 90. As a result, an excessive increase of the pressure in the crank chamber 15 is limited, which prevents the swash plate from being pressed against the limit ring 34 by an excessive force when at the minimum inclination position. Also, the swash plate 31 does not strongly pull the lug plate 30 rearward (rightward in FIG. 1) through the hinge mechanism 32. As a result, the drive shaft does not move axially against the force of the axial spring 20.

When the vehicle is quickly accelerated while the compressor is operating at maximum displacement, the load on the engine Eg can be reduced by disengaging the clutch 23. However, shock is produced when engaging or disengaging the clutch 23, which lowers the vehicle performance. However in this embodiment, the clutch 23 is not disengaged when the vehicle is quickly accelerated, which improves the vehicle performance.

The present embodiment has the following advantages.

Excessive increases of the pressure in the crank chamber 15 are prevented by opening the electromagnetic release valve 95 in the release passage 90. As a result, the drive shaft 16 is prevented from moving axially against the force of the axial spring 20.

The drive shaft 16 does not move with respect to the lip seal 22. That is, the position of the drive shaft 16 with respect to the lip ring 22*a* of the lip seal 22 does not change. Therefore, sludge does not get in the space between the lip ring 22*a* and the drive shaft 16. This extends the life of the lip seal 22 and prevents leakage of gas from the crank chamber 15.

The armature 28 of the clutch 23 moves with respect to the rotor 24 in the direction of axis L and contacts or separates from the rotor 24. In the present embodiment, since the axially rearward movement of the drive shaft 16 is prevented, a desirable clearance is ensured between the rotor 24 and the armature 28 when the clutch 23 is disengaged. Accordingly, power transmission between the rotor 24 and the armature 28 is disrupted without fail while the electromagnetic coil 29 of the clutch 23 is de-excited. This prevents noise, vibration, and heat that are caused by contact between the rotor 24 and the armature 28.

Each piston 35 is connected to the drive shaft 16 through the lug plate 30, the hinge mechanism 32, the swash plate 31 and the shoes 36. The axially rearward movement of the drive shaft 16 is prevented, which prevents the pistons 35 from moving toward the valve plate 14. As a result, the pistons 35 are prevented from colliding with the valve plate 14 at the top dead center position. Therefore, noise and vibration caused by the collision between the piston 35 and the valve plate 14 are suppressed.

The opening size of the pressurizing passage 44 is varied by controller C based on the information including the passenger compartment temperature, the target temperature, and the gas pedal depression degree. Compared to a compressor having a control valve that operates in accordance with only suction pressure, a sudden change of displacement from the maximum to the minimum can occur in the compressor including the control valve 46, that is, the pressure in the crank chamber 15 can be quickly increased. Therefore, the release valve 95 of the compressor of FIG. 1 effectively prevents sudden increases of the pressure in the crank chamber 15.

Compared to a pressure difference valve that opens or closes the release passage 90 according to a difference of pressure between the crank chamber 15 and the suction chamber 37, the release valve 95, which is an electromagnetic valve operated by external instructions, responsively opens the release passage 90 without fail. Accordingly, the release valve 95 limits the pressure in the crank chamber 15.

When the current supply to the coil 64 of the control valve 46 is stopped, the current supply to the solenoid 95*a* is simultaneously stopped and the valve body 95 opens the release passage 90. In other words, the pressure in the crank chamber 15 when the pressurizing passage is fully opened is limited by opening the release passage 90. This is an advantage of the electromagnetic release valve 95, which cannot be achieved by the pressure difference valve.

The control valve 46 varies the displacement of the compressor by changing the flow rate of refrigerant gas from the discharge chamber 38 to the crank chamber 15 by changing the opening size of the pressurizing passage 44. The compressor of FIG. 1 can more quickly increase the pressure in the crank chamber 15 than a compressor that only adjusts the flow of refrigerant from the crank chamber 15 to the suction chamber 37 to vary the displacement. Accordingly, when the compressor is stopped, the displacement is quickly minimized. When the compressor is restarted right after the previous stop, the compressor is started at the minimum displacement without fail. The release valve 95 is especially effective for the compressor of FIG. 1, which tends to excessively increase the pressure in the crank chamber 15.

For example, the structure of the control valve 46 may be changed such that the attraction force between the fixed core 60 and the movable core 61 operates the valve body 52 to increase the opening size of the valve hole 53. In this case, the current supply from the power source S to the coil 64 must be maximized to minimize the displacement especially when the engine Eg is stopped. In other words, it is necessary to maintain the current supply line between the power source S and the coil 64. This requires a drastic change from the existing electrical system.

In contrast, the control valve 46 of the present embodiment only stops the current supply from the power source S to the coil 64 to minimize the displacement when the engine Eg is stopped. Accordingly, it does not matter that the current supply line between the power source S and the coil 64 is disconnected when the engine Eg is stopped. Therefore, the displacement is minimized without changing the structure of existing vehicle electric systems.

The illustrated embodiments can be varied as follows.

Figure 5:
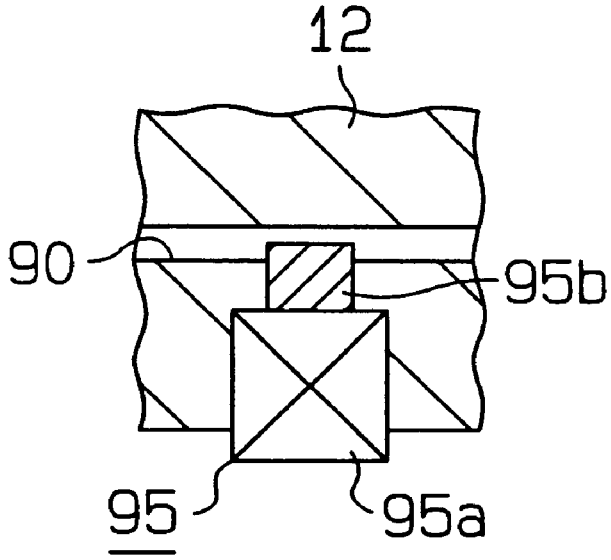
FIG. 5 is a cross sectional view showing a variable displacement compressor according to a second embodiment.

As shown in FIG. 5, the valve body 95*b* may not completely close the release passage 90 when the solenoid 95*a* is excited. This permits restricted gas flow through the space between the release passage 90 and the valve body 95*b* when the difference between the pressure in the crank chamber 15 and the pressure in the suction chamber 37 is smaller than predetermined value. Therefore, the release passage 90 releases gas from the crank chamber 15 with restriction and prevents an excessive increase of the pressure in the crank chamber 15. Accordingly, the bleed passage 45 is not required.

Figure 6:
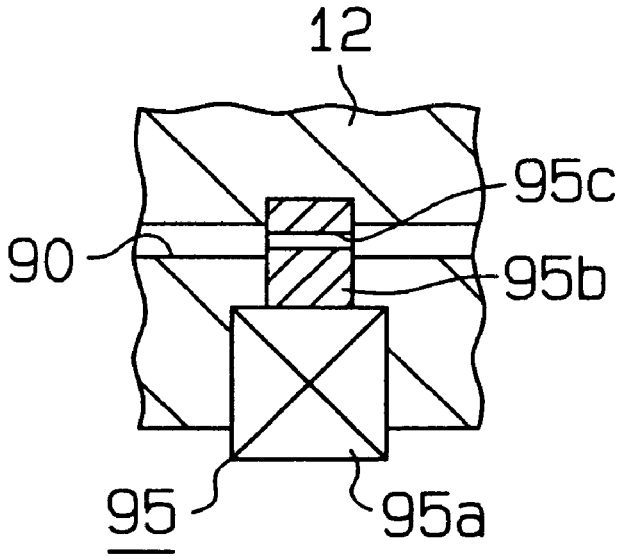
FIG. 6 is a partial enlarged cross-sectional view showing a release valve in a third embodiment.

As shown in FIG. 6, a through hole 95*c* that is smaller than the cross-sectional area of the release passage 90 may be formed in the valve body 95*b* of the release valve 95. When the difference between the pressure in the crank chamber and the pressure in the suction chamber 37 is smaller than predetermined value, or when the solenoid 95*a* is excited, the through hole 95*c* releases gas from the crank chamber 15 in a restricted manner. Therefore, the release passage 90 releases gas from the crank chamber 15 and prevents an excessive increase of the pressure in the crank chamber 15. Therefore, the bleed passage 45 is not required.

Figure 7:
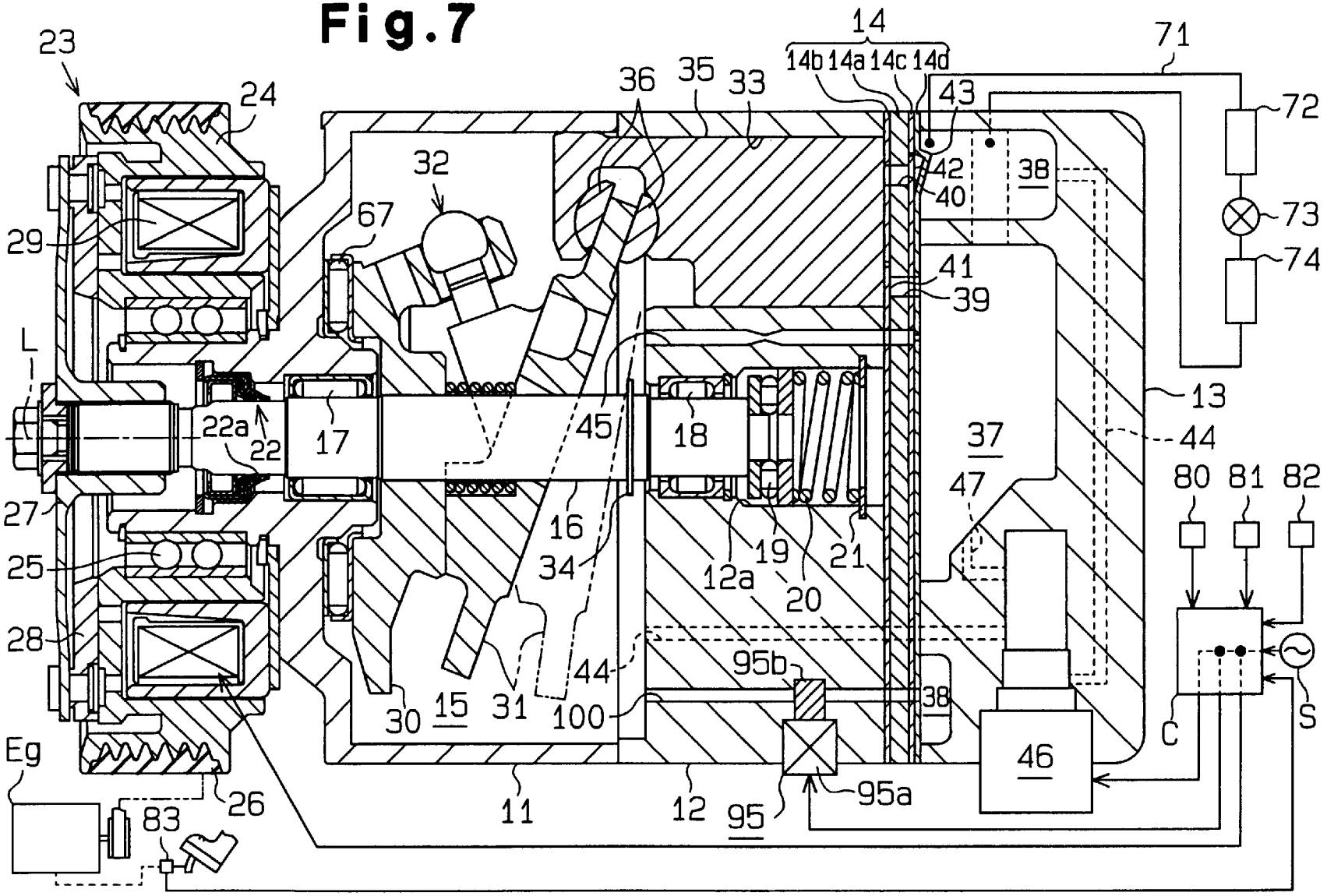
FIG. 7 is a partial enlarged cross-sectional view showing a release valve in a fourth embodiment.
Figure 8:
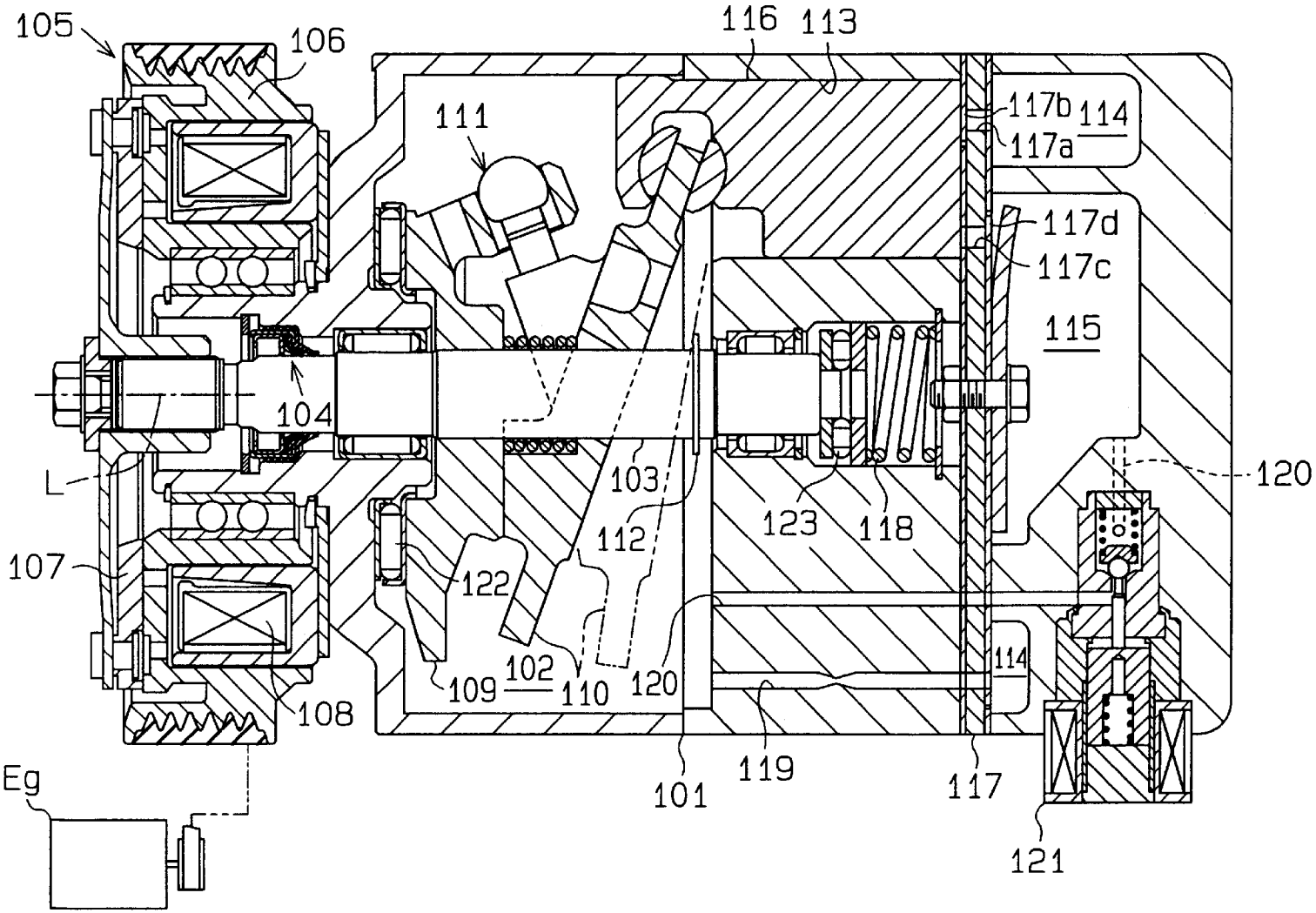
Fig.8 (Prior Art)
FIG. 8 is a cross sectional view of a prior art variable displacement compressor.

As shown in FIG. 7, instead of the release passage 90, a pressure limiting passage 100, which limits the pressure in the crank chamber 15, may be provided between the discharge chamber 38 and the crank chamber 15. The release valve 95 is located in the pressure limiting passage 100. The pressure limiting passage 100 is independent from the pressurizing passage 44. When the pressure in the crank chamber 15 increases excessively, the release valve 95 decreases the opening size of or completely closes the pressure limiting passage 100, which limits the supply of refrigerant gas to the crank chamber 15.

As shown in FIG. 1, the release valve 95 may open the release passage 90 only when the current supply to the coil 64 is stopped while the compressor is operated at the maximum displacement. In other words, when the current supply to the coil 64 is stopped while the compressor is operating at the maximum displacement, the release valve 95 is not opened.

In any of the embodiments shown in FIGS. 1–4, when the gas pedal depression increases, the controller C judges that the vehicle is being quickly accelerated. Instead, the controller C may judge that the vehicle is being quickly accelerated when the engine speed of the engine Eg is greater than a predetermined value.

The present invention may be applied to a compressor that varies the displacement by adjusting the flow of refrigerant gas from the crank chamber 15 to the suction chamber 37 by the control valve 46. In this case, the control valve 46 is located in a passage that connects the crank chamber 15 to the suction passage 37.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A variable displacement compressor comprising:

a housing including a cylinder bore, a crank chamber, a suction chamber, and a discharge chamber;

a piston accommodated in the cylinder bore;

a drive shaft rotatably supported in the housing;

a drive plate coupled to the piston for converting rotation of the drive shaft to reciprocation of the piston, the drive plate being tiltably supported on the drive shaft, wherein the drive plate moves between a maximum inclination position and a minimum inclination position in accordance with the pressure in the crank chamber, wherein the inclination of the drive plate determines the piston stroke and the displacement of the compressor;

a pressure control mechanism for controlling the pressure in the crank chamber to change the inclination of the drive plate;

a control passage for connecting the crank chamber to a selected chamber in the compressor;

a pressure adjusting valve located in the control passage, wherein the pressure adjusting valve regulates gas flow in the control passage; and a controller for controlling the pressure adjusting valve to limit the pressure in the crank chamber to prevent the pressure in the crank chamber from becoming undesirably high.

2. The compressor according to claim 1, wherein the compressor includes an urging member that urges the drive shaft in an axial direction, which restricts axial movement of the drive shaft, wherein the pressure in the crank chamber causes the drive plate to apply an axial force to the drive shaft when the drive plate is located at the minimum inclination position, wherein the controller instructs the pressure adjusting valve to limit the pressure in the crank chamber such that the axial force cannot move the drive shaft against the force of the urging member.

3. The compressor according to claim 1, wherein the pressure control mechanism includes:

a pressurizing passage for connecting the discharge chamber to the crank chamber;

a control valve located in the pressurizing passage, wherein the control valve controls a flow of gas from the discharge chamber to the crank chamber through the pressurizing passage, wherein the control valve substantially fully opens the pressurizing passage to move the drive plate to the minimum inclination position based on commands from the controller.

4. The compressor according to claim 1, wherein the selected chamber is the suction chamber, wherein the control passage allows gas to flow from the crank chamber to the suction chamber, wherein the controller opens the pressure adjusting valve to increase gas flow in the control passage when the pressure control mechanism raises the pressure in the crank chamber.

5. The compressor according to claim 4, wherein the compressor includes a bleed passage that continuously connects the crank chamber to the suction chamber and permits gas to flow from the crank chamber to the suction chamber.

6. The compressor according to claim 5, wherein the bleed passage serves as the control passage, wherein the pressure adjusting valve limits gas flow in the control passage when the pressure in the crank chamber is appropriate.

7. The compressor according to claim 1, wherein the selected chamber is the discharge chamber, wherein the control passage allows gas to flow from the discharge chamber to the crank chamber, wherein the controller controls the pressure adjusting valve to restrict the flow of the gas in the control passage when the pressure control mechanism raises the pressure in the crank chamber.

8. The compressor according to claim 1, wherein, when the pressure control mechanism increases the pressure in the crank chamber to move the drive plate to the minimum inclination position, the controller instructs the pressure adjusting valve to regulate the control passage to limit the pressure in the crank chamber.

9. The compressor according to claim 8, wherein, when the compressor is stopped, the pressure control mechanism increases the pressure in the crank chamber to move the drive plate to the minimum inclination position.

10. The compressor according to claim 8, wherein, when the compressor is operating, the pressure control mechanism normally controls the pressure in the crank chamber such that the drive plate moves to an inclination position that corresponds to a desirable displacement, wherein, when a predetermined condition is satisfied, the pressure control mechanism increases the pressure in the crank chamber to move the drive plate to the minimum inclination position regardless of a desirable displacement.

11. The compressor according to claim 10, wherein an external drive source is connected to the drive shaft to operate the compressor, wherein the predetermined condition is satisfied when there is a particular need to reduce the load applied to the external drive source.

12. The compressor according to claim 8, wherein the pressure control mechanism acts to move the drive plate to the minimum inclination position and, simultaneously, the pressure adjusting valve limits the pressure in the crank chamber.

13. A variable displacement compressor comprising:

a housing including a cylinder bore, a crank chamber, a suction chamber, and a discharge chamber;

a piston accommodated in the cylinder bore;

a drive shaft rotatably supported in the housing;

a drive plate coupled to the piston for converting rotation of the drive shaft to reciprocation of the piston, the drive plate being tiltably supported on the drive shaft, wherein the drive plate moves between a maximum inclination position and a minimum inclination position in accordance with the pressure in the crank chamber, wherein the inclination of the drive plate determines the piston stroke and the displacement of the compressor;

a pressurizing passage for connecting the discharge chamber to the crank chamber;

a control valve located in the pressurizing passage, which controls a flow of gas from the discharge chamber to the crank chamber through the pressurizing passage;

a release passage for connecting the crank chamber to the suction chamber to permit gas flow from the crank chamber to the suction chamber;

an electromagnetic valve located in the release passage, wherein the electromagnetic valve selectively opens and closes the release passage; and a controller for controlling the electromagnetic valve, wherein the controller instructs the electromagnetic valve to close the release passage when the pressure in the crank chamber is appropriate, and the controller instructs the electromagnetic valve to open the release passage to prevent the pressure in the crank chamber from becoming undesirably high when the control valve opens the pressurizing passage to raise the pressure in the crank chamber.

14. The compressor according to claim 13, wherein the compressor includes an urging member that urges the drive shaft in an axial direction, which restricts axial movement of the drive shaft, wherein the pressure in the crank chamber causes the drive plate to apply an axial force to the drive shaft when the drive plate is located at the minimum inclination position, wherein the controller instructs the electromagnetic valve to open the release passage such that the axial force cannot move the drive shaft against the force of the urging member.

15. The compressor according to claim 13, wherein, when the control valve substantially fully opens the pressurizing passage to move the drive plate to the minimum inclination position, the controller instructs the electromagnetic valve to open the release passage to limit the pressure in the crank chamber.

16. The compressor according to claim 15, wherein, when the compressor is stopped, the control valve substantially fully opens the pressurizing passage.

17. The compressor according to claim 15, wherein, when the compressor is operating, the control valve normally regulates the pressurizing passage such that the drive plate moves to an inclination position that corresponds to a desirable displacement, wherein, when a predetermined condition is satisfied, the control valve substantially fully opens the pressurizing passage regardless of a desirable displacement.

18. The compressor according to claim 17, wherein an external drive source is connected to the drive shaft to operate the compressor, wherein the predetermined condition is satisfied when there is a particular need to reduce the load applied to the external drive source.

19. The compressor according to claim 15, wherein the control valve substantially fully opens the pressurizing passage and, simultaneously, the electromagnetic valve opens the release passage.

20. A variable displacement compressor comprising:

a housing including a cylinder bore, a crank chamber, a suction chamber, and a discharge chamber;

a piston accommodated in the cylinder bore;

a drive shaft rotatably supported in the housing;

an urging member that urges the drive shaft in an axial direction, which restricts axial movement of the drive shaft;

a drive plate coupled to the piston for converting rotation of the drive shaft to reciprocation of the piston, the drive plate being tiltably supported on the drive shaft, wherein the drive plate moves between a maximum inclination position and a minimum inclination position in accordance with the pressure in the crank chamber, wherein the inclination of the drive plate determines the piston stroke and the displacement of the compressor, wherein the pressure in the crank chamber causes the drive plate to apply an axial force to the drive shaft when the drive plate is located at the minimum inclination position;

a pressurizing passage for connecting the discharge chamber to the crank chamber;

a control valve located in the pressurizing passage, which controls a flow of gas from the discharge chamber to the crank chamber through the pressurizing passage;

a release passage for connecting the crank chamber to the suction chamber permit gas flow from the crank chamber to the suction chamber;

an electromagnetic valve located in the release passage, wherein the electromagnetic valve selectively opens and closes the release passage; and a controller for controlling the electromagnetic valve, wherein the controller instructs the electromagnetic valve to regulate the release passage such that the axial force cannot move the drive shaft against the force of the urging member.

* * * * *

UNITED STATES PATENT AND TRADEMARK OFFICE

CERTIFICATE OF CORRECTION

PATENT NO. : 6,213,728 B1
DATED : April 10, 2001
INVENTOR(S) : Keiichi Kato et al.

It is certified that error appears in the above-identified patent and that said Letters Patent is hereby corrected as shown below:

Title page,
Item [73], Assignee, please change "Seisakusho +, Kariya" to -- Seisakusho, Kariya --;

Column 3,
Line 28, please change "discharge chamber, A piston" to -- discharge chamber. A piston --;

Column 5,
Line 3, please change "front hosing member 11" to -- front housing member 11 --;
Lines 7-8, there should not be a separate paragraph please change
"the rotor 24.
Accordingly, the armature" to -- the rotor 24. Accordingly, the armature --;
Line 41, please change "Cyclinder bores" to -- Cylinder bores --.

Signed and Sealed this

First Day of October, 2002

*Attest:*

*Attesting Officer*

JAMES E. ROGAN
*Director of the United States Patent and Trademark Office*